United States Patent [19]

Yamamoto

[11] 4,014,625

[45] Mar. 29, 1977

[54] TRANSVERSE FLOW FAN

[76] Inventor: Teruo Yamamoto, 974 Hohjoh, Himeji, Hyogo, Japan

[22] Filed: Oct. 31, 1974

[21] Appl. No.: 519,787

Related U.S. Application Data

[63] Continuation-in-part of Ser. No. 389,512, Aug. 20, 1973, abandoned.

[52] U.S. Cl. ..... 415/54; 415/203

[51] Int. Cl.² ..... F04D 5/00

[58] Field of Search ..... 415/54, 202, 203, 205, 415/148, 211

[56] References Cited

UNITED STATES PATENTS

| | | | |
|---|---|---|---|
| 2,942,773 | 6/1960 | Eck | 415/211 X |
| 3,161,348 | 12/1964 | Laing | 415/54 |
| 3,209,989 | 10/1965 | Eck | 415/54 |
| 3,477,635 | 11/1969 | Glucksman et al. | 415/54 |
| 3,559,298 | 2/1971 | Theilemann et al. | 415/54 |
| 3,664,349 | 5/1972 | Quick | 415/54 X |
| 3,695,775 | 10/1972 | Zenkner | 415/54 X |
| 3,702,918 | 11/1972 | Moller | 415/54 X |
| 3,807,495 | 4/1974 | Skarecky | 415/54 X |
| 3,813,184 | 5/1974 | Temple et al. | 415/54 |
| 3,833,006 | 9/1974 | Temple | 415/54 X |

FOREIGN PATENTS OR APPLICATIONS

| | | | |
|---|---|---|---|
| 44,656 | 10/1918 | Sweden | 415/207 |

*Primary Examiner*—Carlton R. Croyle
*Assistant Examiner*—Edward Look
*Attorney, Agent, or Firm*—Wenderoth, Lind & Ponack

[57] ABSTRACT

A transverse flow fan having improved characteristics for improving performance thereof while substantially reducing or eliminating fan noise characteristic of such fans. The blade angles of the impeller blades are in a particular relationship to the control angles of the surfaces of the tongue in the casing which extends close to the periphery of the fan. Various control means are provided for improving and stabilizing flow through the impeller, such as a control plate in the inflow space, a tongue surface in the outflow space with a specially shaped depression therein, at least one ring around the impeller at a point along the axial length thereof, and various projections projecting into the outflow space. Particular limited relationships are provided between the position of the tongue and the position of the curved outer wall of the casing where it is closest to the impeller and the curvature of the wall relative to the dimensions of the impeller.

7 Claims, 24 Drawing Figures

$\theta g$: ∠ Vc O ZS $\varphi_{max}$ : MAXIMUM FLOW COEFFICIENT $\psi_{open}$ : TOTAL PRESSURE COEFFICIENT WHEN FULLY OPENED $\psi_{max}$ : MAXIMUM TOTAL PRESSURE COEFFICIENT $\psi_{min}$ : MINIMUM TOTAL PRESSURE COEFFICIENT $\psi_{close}$ : TOTAL PRESSURE COEFFICIFNT WHEN SHUT OFF

TRANSVERSE FLOW FAN

This application is a continuation-in-part of U.S. application, Ser. No. 389,512, filed Aug. 20, 1973, now abandoned.

This invention relates to a transverse flow fan. A transverse flow fan is a unique fan which is fundamentally different in its operation from an axial flow fan or a centrifugal flow fan. The transverse flow fan was invented by Mortier in 1892. Early in the 1950's, Eck and Laing stated that the transverse flow was characterized by the existence of an eccentric vortex therein. Since then there has been considerable analytical study of the transverse flow. The analysis has shown that the transverse flow is a two-dimensional flow, and this has developed into the popular theory of today that the transverse flow consists of two regions comprising a forced vortex portion and a potential flow portion enveloping said forced vortex portion therein, as is intensively represented by the theory of compound vortex. However, this theory can not be considered to be directly applicable to the actual state of the transverse flow.

In order to have a more accurate understanding of the transverse flow, I have carried out a systematic experiment comprising measurement of the total pressure distribution in the transverse flow fan by means of Pitot tubes, a detailed examination of the inter-blade and blade surface flows displayed on an oscilloscope connected to a hot-wire anemometer, and analysis of the corresponding noise level. As a result, I have ascertained that fact that, in addition to a forced vortex portion and potential flow portion having substantially constant total pressure which is formed relative to the flow within the transverse flow impeller, there exists between these two flow portions a further flow portion which is hereinafter called a transition intermediate flow portion. Thus, I have reached the conclusion that said transition intermediate flow portion has an important relation to the generation of fan noise, so-called rotation whistle.

The forced vortex portion occupies a minimum region when its center is located adjacent the inner periphery of the impeller, the central angle of the portion of the impeller containing the forced vortex on its inner periphery being approximately 25° when the ratio of the inner and outer peripheral diameters of the impeller is adjacent 0.8, the diameter of the forced vortex portion being approximately 1/5 of the diameter of the impeller. As the vortex center moves toward the center of the impeller away from its inner periphery, the forced vortex portion has a tendency to enlarge, and moreover there is strong evidence that the forced vortex portion tends to lose its characteristic as a forced vortex. Furthermore, when the vortex region is enlarged by reducing the flow through the fan, the size of forced vortex portion is not increased so far as the forced vortex center moves adjacent the inner periphery of the impeller.

The transition intermediate flow portion occupies the space between the forced vortex and the potential flow portion and mainly constitutes a circulating flow along the forced vortex. This portion is a flow of comparatively high speed colliding with strong variation against the blades of the fan impeller when the back current portion thereof flows into the impeller, whereby violent separative variation is caused along the concave surface of the impeller blade at the position of the inflow of the back current portion into the impeller. This variation is observed as a very violent perpendicular variation of great amplitude in the velocity wave, the state of this separative variation being correlated with the degree of the rotation whistle. This is a very important fact providing the most essential factor for the understanding of the cause of generation of the rotation whistle in a transverse flow fan. To be more precise, unlike the case of the axial flow fan or the centrifugal flow fan, in which the blades can be disposed in correspondence with the flow or the flow is substantially determined by the blades, in the case of the transverse flow fan in which the flow is not determined by the blades alone but can be greatly varied by the casing and the like, the variable collision inflow which is generated exclusively in the forementioned definite small portion of the blade lattice of the impeller causes violent separative variation along the concave surface of the blade in said portion, whereby variation in pressure is produced on the blade surface resulting in the production of the rotation whistle. The production of the rotation whistle can be prevented by restricting said separative variation or stabilizing the separation.

Furthermore, in an axial flow fan, the potential interference and viscous wake interference in relation to the tongue member and the blades are considered as a cause of the production of the rotation whistle. However, these factors are negligible in the case of the transverse flow fan. When the flow in stabilized so that no rotation whistle is produced, the viscous wake from the portion ZS of the tongue member Z of the casing most closely adjacent the outer periphery of the impeller, namely, from the forward end ZS of the tongue member separating the inflow space side and the outflow space of the inlet and outlet portions of the casing and separating the vortex portion from the potential flow portion into the inflow blade lattice of the impeller, extends at least straight in the direction of the center of the impeller, scarcely deviating in the rotary direction of the impeller from the portion of the impeller corresponding to the forward end of the tongue member, as shown in FIG. 1.

The peculiarity of the production of variation pressure on the blade surface in the transverse flow fan is attributable to the peculiarity of the flow thereof. Fundamentally, the production of the rotation whistle has no relation to the existence of the tongue member, nor is any direct correlation recognizable thereof with the value of the dimension $\epsilon_2$ of the minimum space between the forward end ZS of the tongue member and the outer periphery of the impeller shown in FIG. 1.

The potential flow portion has a great influence upon the entire vortex flow portion including the transition intermediate flow portion, thereby controlling the shape, size, central force and the like of the vortex flow. In the blades of the impeller distant from the vortex there exists a conversion point at which the flow is converted from inflow to outflow relative to the impeller, the location thereof moving with a predetermined theoretical correlation with the center of the vortex. Therefore, by controlling the position of the conversion point, the potential flow can be generally controlled, whereby the position of the vortex center can be controlled. It is the portion $K_o - K_E$ of the fan corresponding to the central angle $\alpha$ relative to the impeller that performs the foregoing controlling function, as shown in FIG. 1.

In relation to the potential flow circumscribing the vortex flow, the position of inflow into the impeller is determined by the functional inflow controlling portion (the portion controlling the actual inflow) of the tongue member. In relation to the forward end ZS of the tongue member on the inflow space side thereof, the nearer the functional inflow controlling portion to the functional tongue end, the greater is the stability of the potential flow. Moreover, when the direction of the inflow into the impeller is actively controlled adjacent the forward end of the tongue member on the inflow space side, the potential flow portion circumscribing the vortex is greatly influenced, with the result that not only is the vortex flow correspondingly controlled relative to the position of its center and the like, but also the variation in the transition intermediate flow portion is correspondingly controlled as shown in FIGS. 7 and 8. This is a very important fact.

In order to obtain high total pressure in the total flow coefficient region, the vortex center has to be moved along the inner periphery of the impeller. In this case, however, the forced vortex hardly changes its dimension, the circulating flow of the transition intermediate flow portion alone increasing. As a result, the collision inflow region along the impeller is enlarged.

The position and movement of the vortex center are substantially determined by the dimension of the region of the outflow space outside the impeller formed by the casing and the tongue member and also by the shape of the tongue member. Needless to say, the construction of the impeller and particularly the influence of the inner and outer peripheral blade angle are no less important. When the outflow space outside the impeller is small, it sometimes happens that in the maximum flow coefficient region the vortex center overruns the position corresponding to the tongue and ZS between the outflow space and the inflow space. Generally, the movement of the vortex center is largely governed by the dimension of the outflow space outside the impeller, the vortex center moving along the inner periphery of the impeller when said space is large, the vortex center moving toward the interior of the impeller as said space is reduced until the vortex center moves axially relative to the impeller. Moreover, the shape of the tongue member is considered to have an influence mainly upon the movement of the vortex center in the direction of the interior of the impeller.

Not only for the improvement of the efficiency of the fan but also for the reduction of the noise, stabilized control of the flow is the most essential problem to be solved.

Heretofore, it has not been known that the potential flow circumscribing the vortex plays a dominant part in relation to the control of the vortex in the transverse flow fan. To be more precise, the vortex flow is predominantly controlled by the circumscribing potential flow, the potential flow circumscribing the vortex being stabilized if the potential flow is led into the impeller without collision or in a state similar thereto, whereby the vortex flow is controlled with stability. This control of the potential flow is effected by providing the tongue face ZI on inflow space side of tongue Z so that the forward end thereof corresponds with the portion at which the potential flow circumscribing the vortex flow enters the impeller, said forward end being the forward end ZS of the tongue member on the inflow space side which is minimally spaced from the impeller, and by providing the tongue face ZI at a control angle $\delta\iota$ at said forward end so that the tongue face ZI acts as an inflow lead and control face, as shown in FIG. 1. This inflow lead and control angle $\delta\iota$ positively controls and adjusts the direction of the potential flow entering the impeller adjacent the tongue end on the inflow space side of the tongue so as to lead said flow into the impeller without collision or in a state similar thereto. Thus, the variation of the circulating flow portion of the transition intermediate flow portion entering the impeller and colliding with the blades while producing variation pressure along the concave surfaces of the blades is restricted, whereby the production of the variation pressure on the blade surfaces of the inflow blades of the impeller is restricted, resulting in disappearance of the rotation noise. This method of control makes it possible to obtain high performance and low noise at the same time.

When the center of the forced vortex is positioned away from the inner periphery of the impeller, the flow becomes unstable, but the separative action of the circulating portion around the vortex on the inflow blades loses its strength, resulting in a reduction of the noise level. It is important that the positioning of the vortex center be restricted to the scope of the variation thereof which will give good performance. Therefore, in order to maintain the performance at a high level and restrict the noise to a satisfactory level, the movement of the vortex center should be controlled as described hereinafter.

That is, the vortex center should be moved along the inner periphery of the impeller in the opposite direction to the rotation of the impeller in accordance with the reduction of the flow coefficient, thereby leading the vortex center toward the interior of the impeller little by little away from the inner periphery thereof. This can be accomplished by partially varying the dimension of the outflow space in the direction of the axis of rotation of the impeller, for example, by causing the casing surface to project partially into the outflow space defined by the outer periphery of the impeller, the casing and the forward end of the tongue member.

A first object of this invention is therefore to provide a means making it possible to prevent rotation whistle of a transverse flow fan.

A second object of this invention is to provide a means making it possible to lead and control the flow entering the impeller in the inflow direction.

A third object of this invention is to provide a means making it possible to improve the performance of a transverse flow fan by improvement of the casing thereof.

A fourth object of this invention is to provide a means for the improvement of the impeller of a transverse flow fan.

A fifth object of this invention is to provide a means for minimizing the vortex noise of a transverse flow fan without impairing high performance by reducing the outflow area thereof.

These and other objects are accomplished by the parts, improvements, combinations and arrangements comprising this invention, a preferred embodiment of which is shown by way of example in the annexed drawings and herein described in detail, in which.

Figure 6:
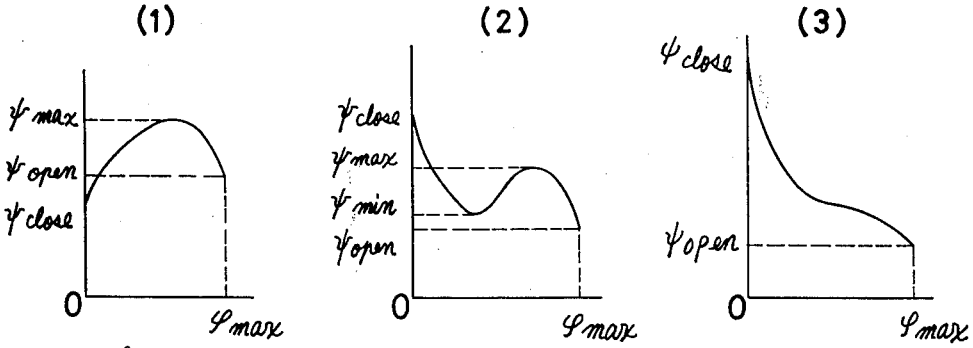
Figure 11:
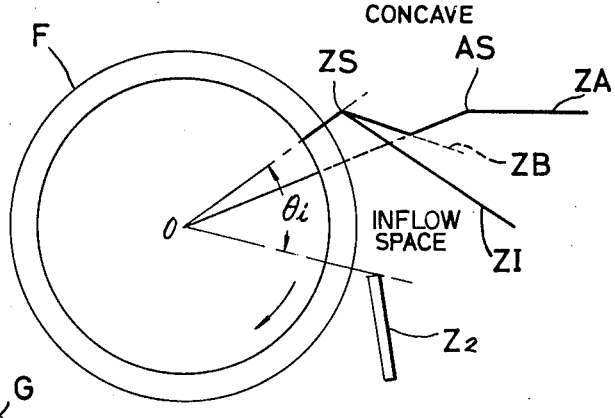
Figure 12:
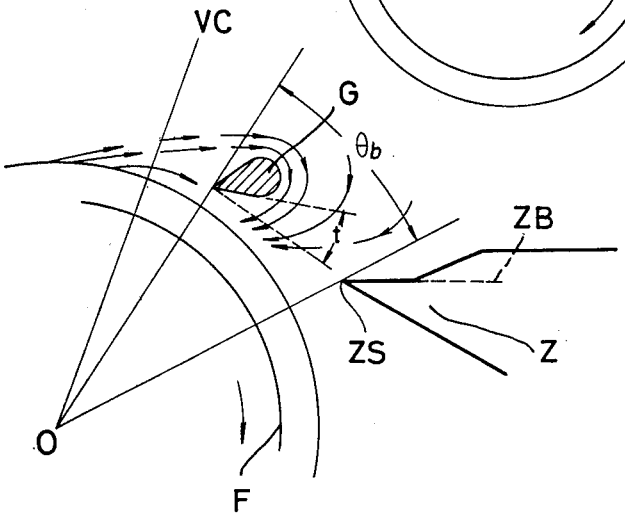
Figure 14:
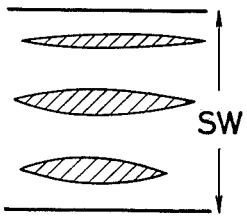
Figure 15:
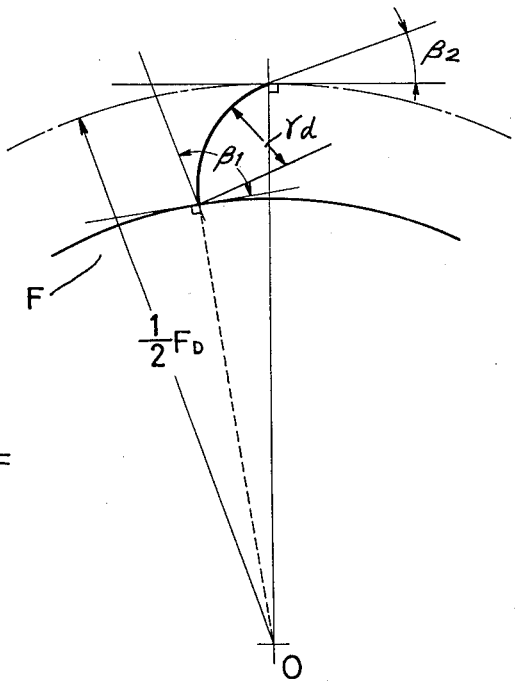
Figure 13:
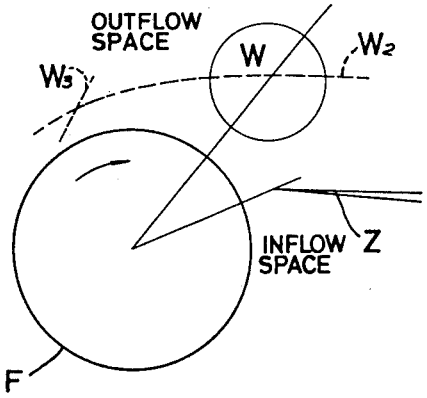

FIG. 6, (1), (2), (3) are graphs showing the performance curves of the transverse flow fan of the invention;

FIGS. 7, 8, 9 and 10 are further graphs showing the performance curves of the transverse flow fan of the invention;

FIG. 11 is a diagrammatic elevation showing a tongue member is disposed adjacent the outside of the impeller;

FIG. 12 is a diagrammatic partial elevation showning a control bar is disposed adjacent the outside of the impeller;

FIG. 13 is a diagrammatic partial elevation showing a projecting construction is disposed adjacent the outside of the impeller;

FIG. 14 is a longitudinal, sectional side elevation showing a damper is provided adjacent the outflow portion;

FIG. 15 is a diagrammatic partial elevation of the impeller; and

FIGS. 16*a* and 16*b*, 17*a* and 17*b*, 18*a* and 18*b*, and 19*a* and 19*b* are respectively schematic side sectional and end elevation views showing modifications of the transverse flow fan according to the invention.

Figure 1:
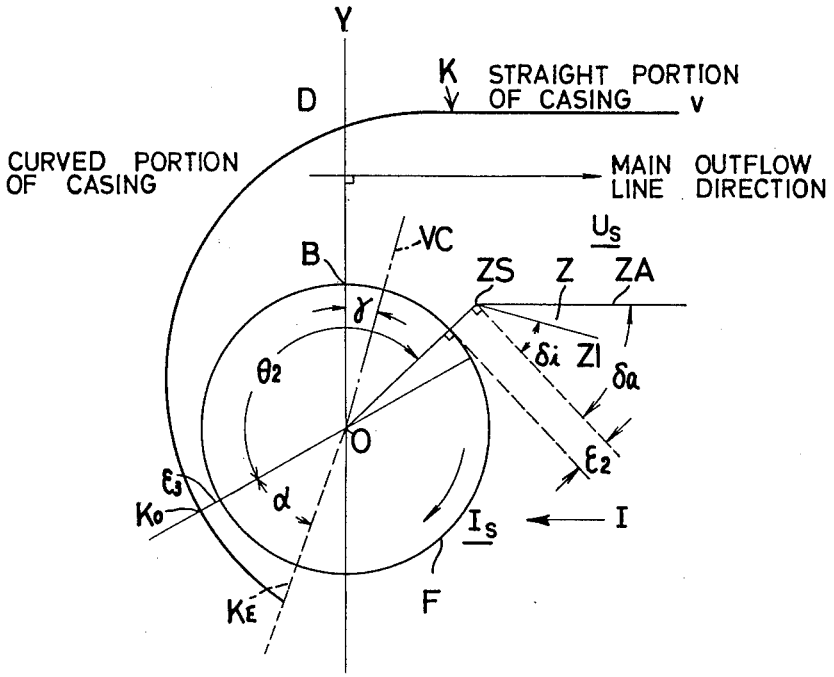
FIG. 1 is a sectional elevation of a transverse flow fan according to this invention, taken transversely of the impeller.

Referring now to FIG. 1, the fan has a casing K with an inlet I having an inflow space Is and an outlet U having an outflow space Us, and a transverse flow impeller Y designates a straight line traversing the center O of the impeller F and making a right angle with the direction of the main outflow line through the outflow space Us, B designating the intersection of the straight line Y and the outer periphery of the impeller F, D designating the intersection of the straight line Y and the casing K. A laterally V-shaped tongue member Z is provided in the casing having an outflow space side tongue face ZA in the outflow space Us parallel with the direction on the main outflow line and an inflow space side tongue face ZI in the inflow space Is as an inflow guide and control fact. The forward end ZS of the tongue member Z (in the construction of the tongue member, the portion occupying the position adjacent the impeller and constituting a projection toward the impeller is called the forward end of the tongue member) is the forward end of the inflow space side tongue face facing the inflow space, namely, the forward end of the tongue member on the inflow space side, said forward end simultaneously being the forward end of the tongue member on the outflow space side, and is minimally spaced from the outer periphery of the impeller F. VC designates a diametrical line through the vortex center from the center O of the impeller. $K_o$ designates a portion of the casing most closely adjacent the impeller F. $\theta_2$ designates a central angle of the impeller containing $K_o$ and ZS on the outflow space side, $\gamma$ designating a central angle of the impeller F containing Y and VC on the outflow space side. $K_E$ designates the end portion of a flow control construction provided beyond $K_o$ in the opposite direction to the rotation of the impeller F as if extended from the casing K. $\delta\alpha$ designates a control angle of the outflow space side tongue face ZA and $\delta\iota$ designates a control angle of the inflow space side tongue face ZI, both angles being measured from a line intersecting the tip of the tongue adjacent said impeller and parallel to a tangent to the impeller adjacent said tip of said tongue. $\epsilon_2$ designates the minimum space between the tongue end ZS and the outer periphery of the impeller F, $\epsilon_3$ designates the minimum space between the portion $K_o$ of the casing K and the outer periphery of the impeller F, and $\alpha$ designates a central angle of the impeller F containing $K_o$ and $K_E$ therein.

Now, it is a matter of common knowledge that the ratio between the inner peripheral diameter and the outer peripheral diameter of the transverse flow impeller F, should be within the range of 0.7 – 0.85. However, in transverse flow, unlike the case of axial flow or centrifugal flow in which the flow is substantially determined by the blades, the flow is not determined by the impeller alone, but is distinctly influenced by the casing and the tongue member. Therefore, the most suitable value of the ratio between the inner and outer diameters of the impeller is not determinable independently but has to be determined in connection with many other factors.

The inner peripheral blade angle $\beta_1$, i.e. the angle of the inner end of the impeller blade with the tangent to the inner periphery of the impeller, is from 70° – 100° as shown in FIG. 15. However, if $\beta_1$ is smaller than 90° in the case of an impeller for practical use, stabilized control of the flow is rather difficult. The range of $90° < \beta_1 < 100°$ is favorable for vortex control. The outer peripheral blade angle $B_2$, i.e. the angle of the outer end of the blade with a tangent to the outer periphery of the impeller, as shown in FIg. 15 is generally from 25° – 45°. If $\beta_2$ is smaller than 25°, the forced vortex center tends to be attracted to the outflow side within the vortex flow and said center being likely to be located too far on the inflow side of $\beta_2$ is less than 25°. In the vicinity of $\beta_2 = 25°$, the forced vortex is located in the center of the vortex flow region adjacent the inner periphery of the impeller. If the value of $\beta_2$ is large, the area occupied by the circulating flow of the transition intermediate flow portion in the outflow space outside the impeller increases. This must be avoided since it is likely to result in a reduction of the maximum flow coefficient.

The curvature of the concave face of the blade has considerable influence on the performance of the transverse flow fan. The radius of curvature $\gamma d$ shown in FIG. 15 should be less than 1/10 of the outer peripheral diameter $F_D$ of the impeller. Where $\gamma_d > 1/10\ F_D$, the performance is generally poorer as compared with the case where $\gamma_d < 1/10\ F_D$.

Accordingly, it is desirable that the radius of curvature of the concave face of the blade be less than 1/10 of the outer peripheral diameter of the impeller, the inner peripheral blade angle $\beta_1$ be $90° < \beta_1 < 100°$, and the outer peripheral blade angle $\beta_2$ be at least $\beta_2 < 30°$. With regard to the concave face of the blade, the noise level can be reduced by making the portion adjacent the outer periphery of the impeller rectilineal.

The number of blades has a correlation with the value of the ratio between the inner and outer diameters of the impeller and the outer peripheral diameter $F_D$ thereof.

The smaller the value of the ratio between the inner and outer diameters, the smaller should be the number of blades. The greater the outer peripheral diameter $F_D$, the greater the number of blades. The similarity law is not applicable to the impeller.

The number of blades is in proportion to the value of the ratio between the inner and outer diameters and to the square root of the outer peripheral diameter. If the value of the ratio between the inner and outer diameters of the impeller is 0.8, and the outer peripheral diameter is 12 cm, then the standard number of blades is 28 – 30.

Figure 2:
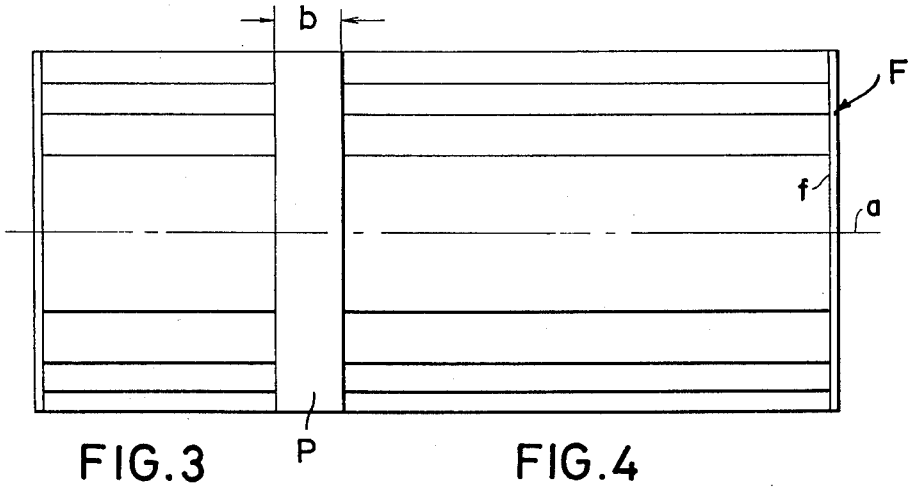
FIG. 2 is a plan view of an impeller of the same.

As shown in FIG. 2, if a band-shaped annular member (ring) P having a width $b$ is provided around the outer periphery of the central part of the impeller F, the flow is changed at the portion of the annular member P, the influence spreading over the whole length of the impeller, the vortex center showing a tendency to depart slightly from the inner periphery thereby enlarging the vortex region within the impeller, and the vortex center is shifted in the opposite direction to the direction of rotation of the impeller, whereby the transverse flow is generally stabilized. Thus, the violent separative variation along the concave surface of the blade is placed under control in the part of the impeller in which the back current of the circulating flow of the transition intermediate flow portion flows into the impeller, whereby the production of pressure variation on the blade surface is restricted resulting in the disappearance of the rotation noise. It must be noted that the position of the band-shaped annular member P can be anywhere in the direction axially of the impeller F. The width b has no direct relation to the value of the diameter of the impeller F, a width of a few millimeters being sufficiently effective. The number positions at which such an annular member can be mounted can be increased if the overall length of the impeller F is great, although a large number of annular members P is not required. The annular member P may be mounted on the impeller in the form of an intermediate ring so as to constitute a structural member of the impeller.

The overall control of the transverse flow by the band-shaped annular member is a phenomenon peculiar to a transverse flow fan. As the phenomenon shows, it is not necessary to provide the control devices over the whole length of the impeller as far as the transverse flow fan is concerned, part of the devices, even the greater part thereof, depending upon the nature of the device, being omittable. Sometimes it is necessary to omit the greater part of the control devices, that is, it sometimes happens that a better result is obtainable in the overall control of the transverse flow by providing the control devices in a limited part of the entire length of the impeller. This is called partial control of the transverse flow. Means for such partial control can act as means to control the entire flow and can be used in both the inner and outer regions of the transverse flow impeller. The partial control means can be a lead device within the impeller, a tongue device outside the impeller (including the space $\epsilon_2$), a casing, an outflow pulse control device, a vortex control device and the like. All these devices are effective means for controlling the two-dimensional transverse flow.

With regard to the casing K, as shown in FIG. 1, the curvature thereof can be represented by the formula $L = k\theta + m$ (wherein $k$ and $m$ are constants), the center O of the impeller F being the origin, $\theta = O$ for $OK_o$, $\theta$ denoting the angle which varies in the direction of the rotation of the impeller F, L denoting the distance from the origin O to the curved casing wall for the corresponding angle $\theta$. Similarly, an eccentric circular arc corresponding to an impeller F having a radius about twice the length of the radius of the impeller F can be used as the casing curve. These are suitable for obtaining all the basic types of the total pressure performance curves. Referring now to FIG. 1, the value of the ratio between the segment BD and the outer peripheral diameter of the impeller is represented by $e$, and a value within the range of $0.3 \leqq e \leqq 0.8$ should be given to $e$. In the vicinity of $e = 0.3$, the characteristic advantages of the impeller are not fully achieved, and therefore it is most likely that the dimension of the outflow space within said scope is the standard for the transverse flow fan.

It is certain that the foregoing casing curve is better than a logarithmic helix in which the total pressure performance curve tends to be flat.

Figure 5:
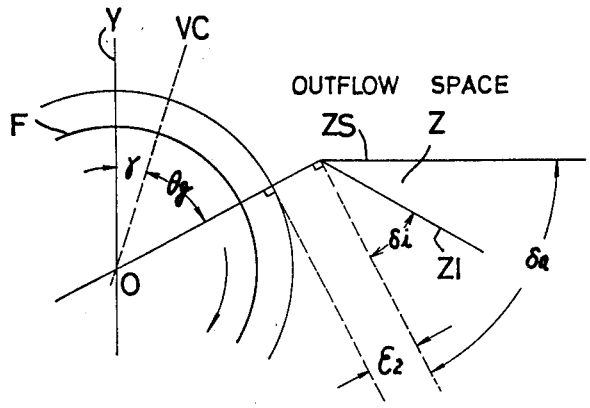
FIG. 5 is an enlarged view of a portion of FIG. 1.
Figure 16A:
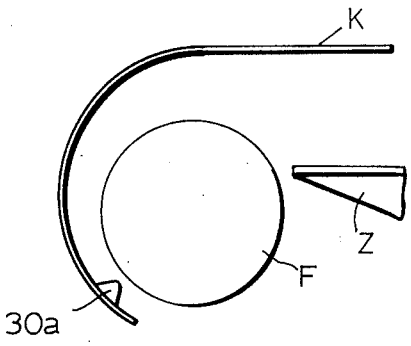
Figure 16B:
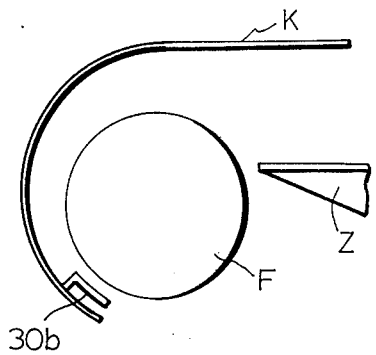

A suitable dimension of the minimum space $\epsilon_3$ at the portion $K_o$ of the casing is 1/10 – 1/6 of the diameter of the impeller F, namely, the distance at which the influence of the blade wake begins to disappear. However, when $\theta_2$ in FIG. 1 is small and the value of the maximum flow coefficient $\zeta$ max is small, a restriction on the interblade flow occurs within the range of about 20° –40° for the impeller control angle measured in the direction of rotation of the impeller from $OK_O$. In this case, the outflow to the outflow space of the casing is restricted by locally reducing $\epsilon_3$ by providing a projection 30*a*, as shown in FIG. 16*a*, locally projecting toward the impeller F in the portion $K_O$ of the casing, or a plate member 30*b*, as shown in FIG. 16*b*, projecting toward and then along the impeller, or by convering the outer periphery of the impeller F for a short distance in the direction opposite to the direction of rotation of the impeller F from the portion $K_o$, whereby $\zeta$ max can be improved. Moreover, if a casing portion $K_o - K_E$ is provided as a continuation of the casing or independently thereof, the position of the conversion point at which the inter-blade flow changes its direction from inflow to outflow relative to the potential flow portion is controlled, thereby making it possible to establish the inflow into the spaces between blades at the portion of the impeller adjacent the portion $K_o - K_E$. As the impeller central angle $\gamma$ corresponding to the portion $K_o$–$K_E$ is increased, the conversion point moves in the direction opposite to the direction of the rotation of the impeller F in the maximum flow coefficient region, and the vortex center also moves further away from the tongue member Z, whereby $\theta g$ in FIG. 5 is increased. With regard to the performance, the portion $K_o$–$K_E$ increases the total pressure coefficient, but it is important that the value of $\alpha$ be such as not to overrun the diametrical line traversing the vortex center when the portion of $K_E$ is at the maximum flow coefficient $\zeta$ max in the direction opposite to the direction of rotation of the impeller. If the position $K_E$ is beyond said diametrical line, the total pressure coefficient declines. In such a case, the central angle of the impeller containing $K_E$ and said diametrical line must not exceed 20°.

With regard to the construction and shape of the tongue member, great efforts have hitherto been made by many research workers comprising Eck, Laing, Coester, Ilberg, Zenkner, etc.

Figure 3:
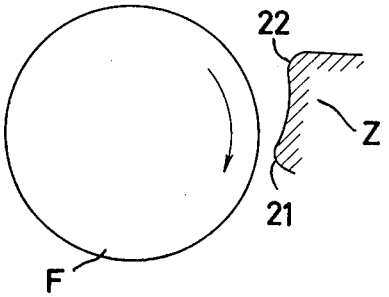
FIG.3 PRIOR ART
FIGS. 3 and 4 are diagrammatic elevations showing prior art tongue members disposed adjacent the outside of the impeller respectively.
Figure 4:
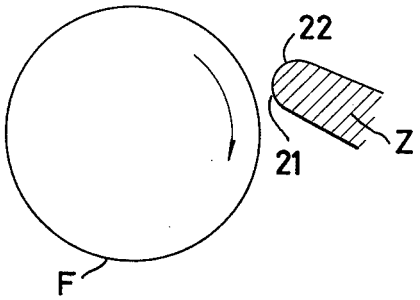
FIG.4 PRIOR ART

Eck pointed out that a plate-shaped tongue member produced a high rotation whistle. Coester stated that a wedge-shaped tongue member gave rise to a sharp noise. In experiments of Zenkner and Ilberg the flow was so controlled that the vortex center was positioned adjacent the forward end of the tongue member by making use of a wedge-shaped tongue member. Eck, who endeavored to stabilize the vortex, introduced various kinds of tongue mechanisms. The direct vortex control tongue means, a stabilizer tongue introduced by Eck, which is useful even today, comprised a tongue face which covered an arc along a predetermined part of the outer periphery of the impeller, the diametrical size of the space between the tongue face and the outer periphery of the impeller decreasing in the direction of rotation of the impeller. FIG. 3 shows one type of such a tongue. FIG. 4 shows the lead tongue member of Laing which is intended to control the vortex by means of a convex face on the tongue member. In both types, the vortex control performance is thought to come from the portion of the tongue face between points 21 and 22. However, in the region of the maximum flow coefficient $\zeta$ max, the vortex flow is larger in the case of the stabilizer tongue member of Eck than in the case of the guide tongue member of Laing, the force of the vortex flow being weaker in the former case. In the former case, the circulating flow of the transition intermediate flow portion is enlarged, and the region in the blade portion with which the circulating flow collides corresponding to the vortex control face of the tongue member is larger than in the latter case, though the force causing the separative variation along the blade surface is weaker than in the latter case. In both cases, the vortex center is comparatively stabilized, but the disturbance of the flow increases as the flow coefficient $\zeta$ decreases.

With regard to the wedge-shaped tongue member of Zenkner and Ilberg, the state of the flow is quite similar to that of the stabilizer tongue member of Eck.

As is apparent from these tongue means, the idea of directly controlling the vortex was derived from the concept that the transverse flow through the impeller comprised a compound vortex. This was perhaps because the discovery of the fact that "the transverse flow necessarily comprises a vortex" was such a remarkable one.

Now, what is essential in relation to the transverse flow fan is to make an intensive study of the fact that "the vortex as a whole is predominantly controlled by the potential flow on the outside thereof, and the vortex is indirectly controllable by controlling said potential flow." Heretofore, no research has been done with respect to the fundamental quide and control function that the tongue face on the inflow space side exercises in relation to the transverse flow.

The applicant has made the following study in reference to the wedge-shaped tongue member Z shown in FIG. 5. The casing was selected so as to be applicable to all the types of performance curves.

The performance curves (flow coefficient $\zeta$— total pressure coefficient $\Psi$ curve) of the transverse flow fan are fundamentally divisible into three types as shown in FIG. 6.

The type of the performance curve ($\zeta$—$\Psi$ curve) shown in FIG. 6 corresponds to the value of $\theta_2$ in FIG. 1. $\theta_2$ designates the center angle of the impeller containing the portion $K_o$ at which the space between the casing and the outer periphery of the impeller is a minimum value and the forward end ZS of the tongue member on the outflow space side of the impeller.

The value of $\theta_2$ corresponding to the type 1 performance curve is $120° \leqq \theta_2 \leqq 160°$. $\theta_2$ should be within this range when a high pressure coefficient is desired.

The value of $\theta_2$ corresponding to the type 2 performance curve is $160° \leqq \theta_2 \leqq 180°$. $\theta_2$ should be within this range when an increased maximum flow coefficient is desired.

The value of $\theta_2$ corresponding to the type 3 performance curve is $180° \leqq \theta_2 \leqq 200°$. $\theta_2$ should be within this range if the requirements are to increase the closed pressure coefficient and to obtain a stabilized performance curve slanting downwardly to the right.

Figure 7:
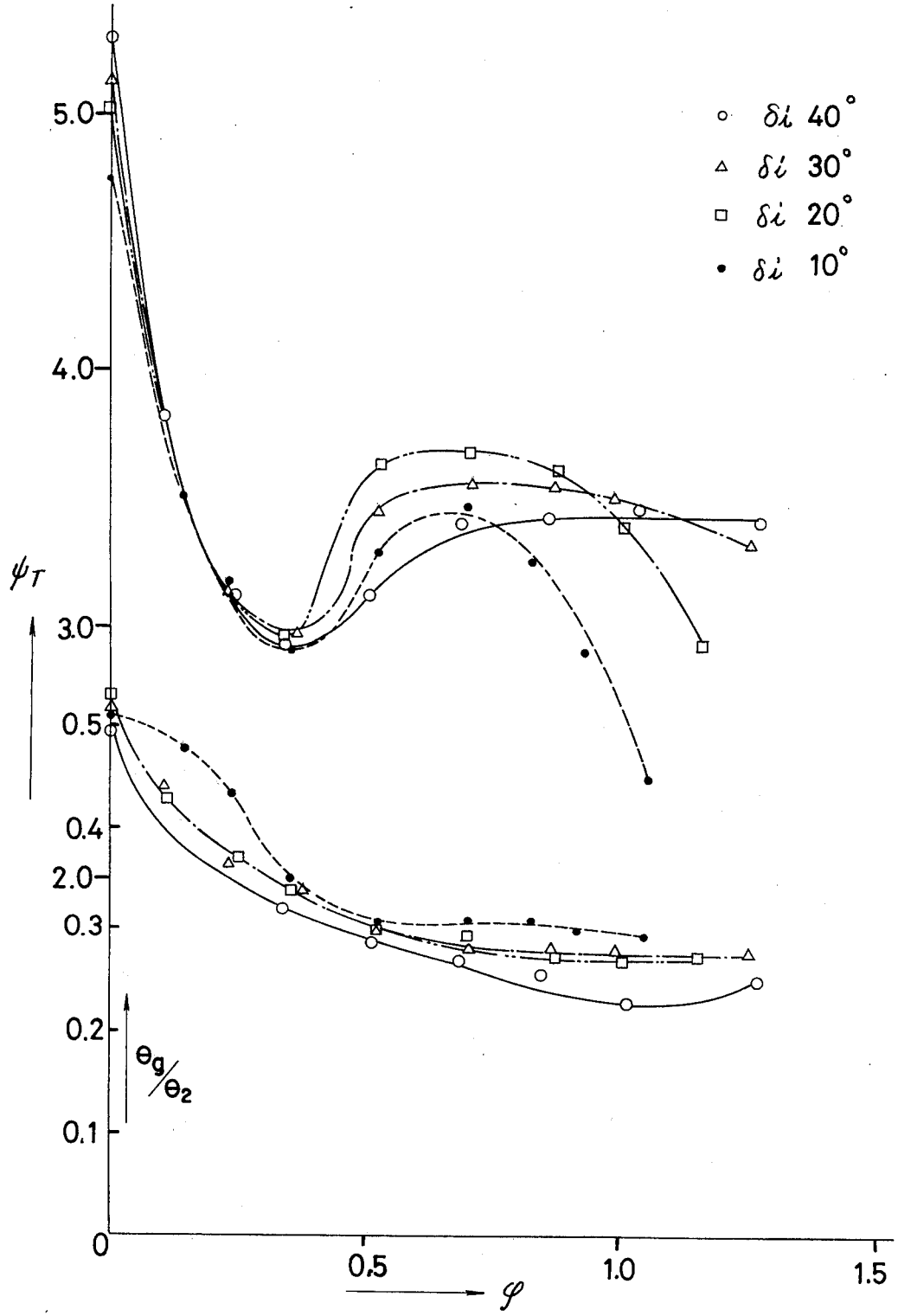

The tongue member used in the experiment was provided in accordance with the following conditions: the control angle $\delta$ of the outflow space side tongue face was given the values, (1)$\delta\alpha = 40°$ ($\theta_2 = 160°$) and (2)$\delta\alpha = 75°$ ($\theta_2 = 195°$) respectively, the minimum space $\epsilon_2$ between the forward end ZS of the tongue member and the outer periphery of the impeller was $\epsilon_2 = 0.08 \times F_D$ (the outer peripheral diameter of the impeller). The position of the vortex center and the corresponding performance were measured while varying the inflow direction control angle $\delta\iota$ of the inflow adjacent the forward end of the inflow space side tongue face ZI. The results are as shown in FIG. 7 for $\delta\alpha = 40°$ and in FIG. 8 for $\delta\alpha = 75°$ respectively. In order to show the variation of the vortex center, a non-dimensional value $\theta g/\theta_2$ was used, $\theta g$ (see FIG. 5) being the angle containing therein the diametrical line indicating the position of the tongue end ZS and the line Vc of the vortex center on the outflow space side of the impeller.

Figure 8:
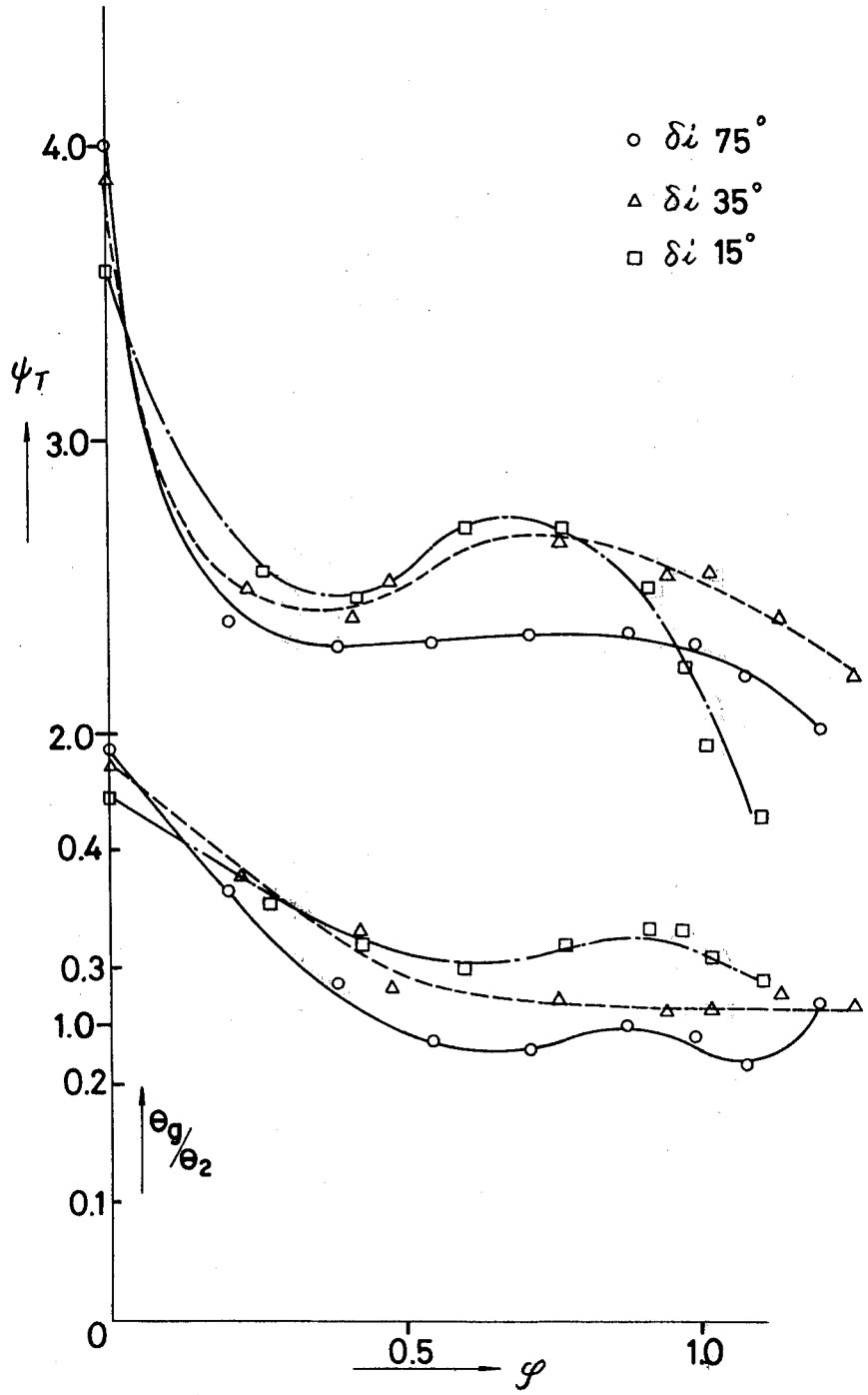

As is apparent from FIGS. 7 and 8, $\delta\iota$ has a great influence on the position of the vortex center in the region of the total flow coefficient. To be more precise, the spacing of the vortex center from the tongue member is increased by a decrease of the guide and control angle $\delta\iota$ insofar as the inflow of the potential flow along the inflow space side tongue end is not interferred with. Thus, the inflow line guide and control angle $\delta\iota$ of the potential flow at the forward end part of the inflow space side tongue face plays an important role in the control of the vortex flow, and its influence is distinctly apparent in the performance curves.

Figure 9:
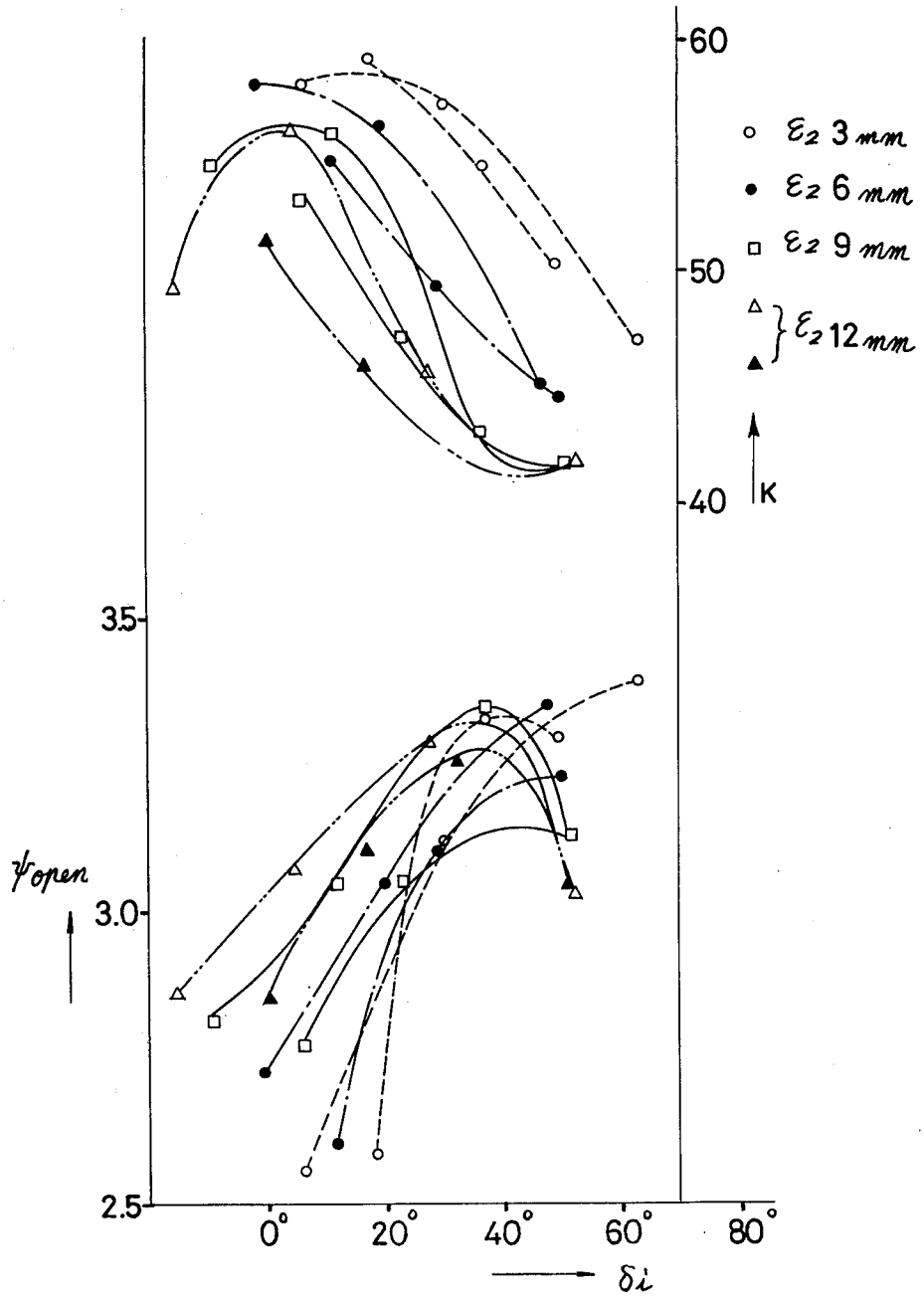
Figure 10:
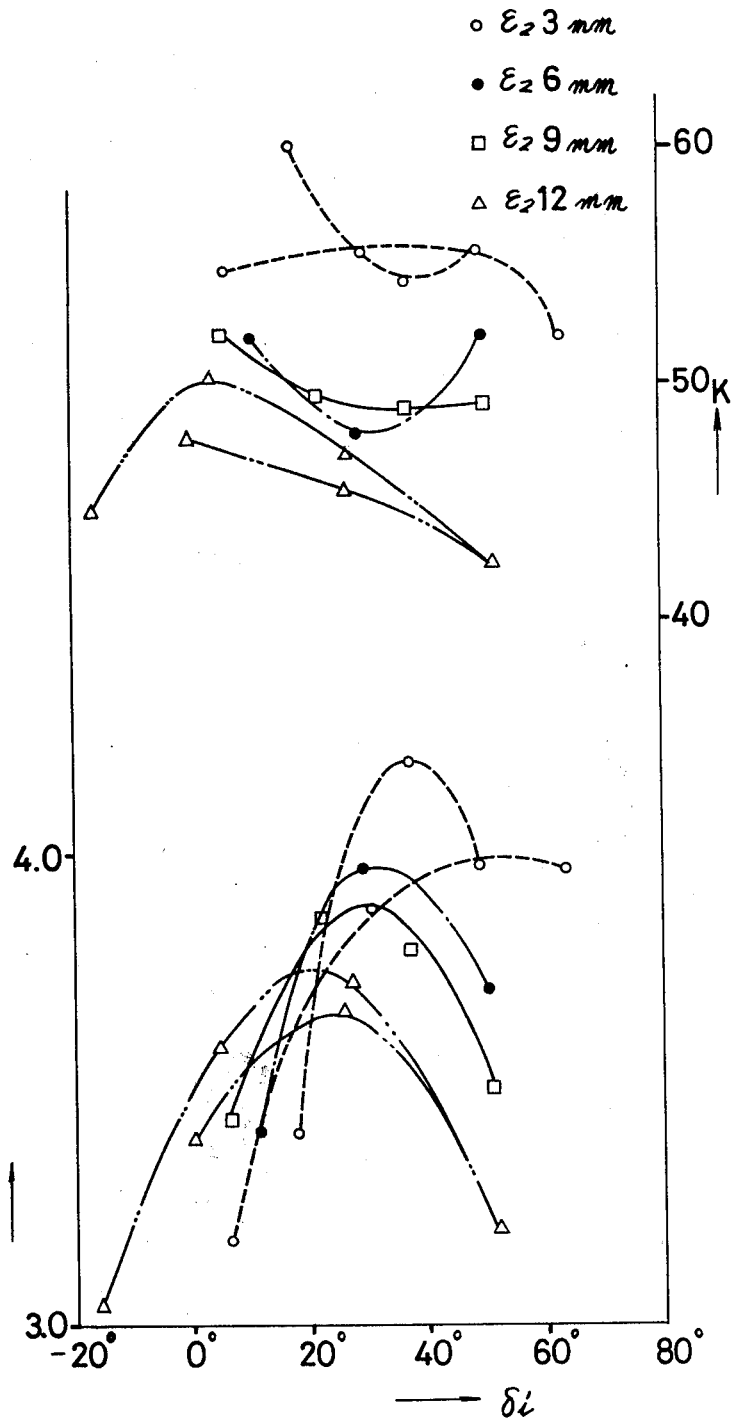

With regard to the relation among the dimension of the minimum space $\epsilon_2$ between the tongue end and the impeller, the total pressure coefficient $\Psi$ open corresponding to the maximum flow coefficient, the maximum total pressure coefficient $\Psi$ max, and the noise level K represented by $K = SPL - 10 \log_{10} QH^2$ (wherein Q = flow and H = pressure), FIG. 9 shows the corresponding relation among $\epsilon_2$, $\delta\iota$, $\Psi$ open and K, and FIG. 10 shows the same among $\epsilon_2$, $\delta\iota$, $\Psi$ max and K, respectively.

As is apparent from FIGS. 9 and 10, the value of the total pressure coefficient $\Psi$ is invariably influenced by $\delta\iota$, a most suitable $\delta\iota$ existing for each corresponding value of $\epsilon_2$ respectively for a minimum value of the noise level K which results in a maximum value of the performance. The smaller $\epsilon_2$, the greater the suitable value of $\delta\iota$, said value decreasing according as $\epsilon_2$ increases.

As is apparent from the foregoing, it is necessary that the forward end of the tongue member (the portion ZS in FIG. 5) be positioned in a position corresponding to the portion of the flow in which the potential flow portion flowing to the outflow portion Us is separated from the vortex portion flowing into the impeller, i.e. the transition intermediate flow portion, and the inflow guide and control angle $\delta\iota$ of the flow at the forward end of the tongue member plays a very important part in the control of the transverse flow through the impeller.

When the outer peripheral blade angle $\beta_2$ is $\beta_2 = 25°$, the most suitable value of $\delta\iota$ is in the vicinity of 20°–40°. Generally, the most suitable value of $\delta\iota$ is considered to be within the range ($\beta_2 - 15°$) $\delta\iota$ ($\beta_2 + 15°$). For these angles, it has been derived from FIGS. 9 and 10 that $\epsilon_2$ should be from 0.03 $F_D$ to 0.15 $F_D$.

The forward end of the inflow space side tongue face, namely, the tongue end on the inflow space side (the portion ZS in FIG. 5) should have an acute angle or a slightly obtuse angle and the radius of curvature of the forward end should be less than approximately 3 mm regardless of the size of the impeller, and the viscous wake should be controlled from he forward end of the tongue member. This is essential to obtain satisfactory performance from $\delta\iota$.

In order to stabilize the vortex flow, it is most important that the inflow be inwardly guided with stability at the forward end of the tongue member on the inflow space side without collision with the impeller or in a state similar thereto while being brought into contact with the back current inflow of the vortex. No successful stabilized control of the vortex can be achieved if the foregoing rule is ignored. When the vortex flow and the circulating flow portion are stabilized, the separation of the back current portion on the blade surface is stabilized, thus the separative variation is controlled and the generation of variation pressure on the blade surface is checked, resulting in disappearance of the rotation noise.

Even when the size of the vortex region along the inner periphery of the impeller is reduced, the fan performance is not always improved. However, the smaller the value of $\gamma$ shown in FIG. 1 and 5, the higher is the performance of the fan. This is also the case with the instance in which Vc overruns Y in the direction opposite to the direction of rotation of the impeller at the time open flow (maximum flow coefficient), namely, it is necessary that the value of $\gamma$ be controlled so as to be within the range $\gamma \leqq 20°$ in the maximum flow coefficient range. The nearer to zero the absolute value of $\gamma$, the higher the fan performance. In this instance, the outflow space necessarily shows a tendency to increase.

As is apparent from FIGS. 9 and 10. the value of $\epsilon_2$ has no casual relation directly with the performance and the noise of the fan. In the case of a wedge-shaped tongue member, if it is so designed that the portion in which the potential flow enters the impeller is separated from the portion corresponding to the tongue end in the direction of rotation of the impeller, the vortex center approaches the tongue member and moves toward the interior of the impeller.

It is important to realize that the forward end of the tongue member has no decisive influence on the vortex flow and its center, but the state of flow produced by the entire construction of the tongue member controls the vortex, that is, the essential problem in the control of the vortex is to find out from what portion of the impeller and in what state the potential flow coming into contact with the vortex flow flows into the impeller.

In FIGS. 1 and 5, the outflow space side tongue face ZA is for guiding the outflow, and in many cases the end portion adjacent the forward end ZS acts to guide the back current portion of the circulating flow along the vortex. When the control angle in said forward end portion is $\delta\alpha \leqq 90°$, the value of the total pressure coefficient $\Psi_T$ corresponding to the maximum flow coefficient $\zeta$ max is greater than for the case where $\delta\alpha > 90°$.

In the modification shown in FIG. 11, a concavity is formed adjacent the forward end ZS of the tongue facing the outflow space Us, the point at which the concavity joins the outflow space side tongue face ZA being at AS, the surface forming the concavity by joining the tongue forward end ZS being designated ZB.

As shown in FIG. 11, the concavity having a face ZS-AS is formed in the tongue face toward the outflow space by joining a surface ZB having smaller control angle $\delta_{2B}$ than that of the line connecting ZS and AS to ZA, namely $\delta t \leqq \delta_{2B} \leqq \beta_2 + 25°$, thereby causing the surface ZB to guide the back current portion of the vortex. Now, the distributed static pressure on the concave surface ZS—AS becomes higher than that on the tongue face of the Eck type thereby increasing the total pressure coefficient $\Psi_T$ in the region of the low flow coefficient $\zeta \leqq 0.3$. Moreover, the circulating flow of the transition intermediate flow portion on the outside of the impeller is not enlarged outwardly beyond the point AS, the point AS becoming the marginal point to divide the outflow from the back current portion of the vortex. As compared with an outflow space side tongue face having no concavity, the tongue face having a concavity has a strong tendency to check the growth of variation pressure on the blade surface of the impeller, thereby decreasing the noise.

At the inflow blade lattice of the impeller, a great separative variation occurs very frequently along the blade surface except adjacent the tongue forward end, and this phenomenon happens in the central portion of the inflow arc (the central portion of the blade lattice facing the inflow space). If the angle between the inflow space side tongue forward end ZS and the portion producing said separative variation on the side of the impeller toward the inflow space is represented by $\theta_i$ (see FIG. 11), then $\theta_i \cong 70°$ experimentally, the range being approximately $50° \leqq \theta_i \leqq 90°$. Said separative variation can be distinctly improved by providing an inflow guide and control plate $Z_2$ which can be called a secondary tongue, as shown in FIG. 11.

The central angle of the inflow arc of the impeller when a stabilized high performance curve is obtained is in the range of 120° –160° in relation to the effective flow, and $200° \leqq (\theta_2 + \alpha) \leqq 240°$ with regard to $\theta_2$ and $\alpha$ shown in FIG. 1. It is desirable that the diametrical line of the impeller traversing the vortex center at the time of the maximum flow $\phi$ max does not intersect the casing line at a portion corresponding to $\alpha$, since this makes it possible to obtain a high total pressure coefficient as described hereinbefore.

Because of the peculiarity of the transverse flow, partial control acts effectively on the overall length of the impeller as already stated. The tongue mechanism is not necessarily indispensable at the time of the maximum flow $\phi$ max. This is an interesting phenomenon.

A control bar G shown in FIG. 12 is a direct control means for the vortex independent of the guide means within the impeller and the tongue. As shown in FIG. 12, the control bar G is provided along the entire length of the impeller adjacent the outer periphery at a position spaced at a central angle $O_b$ from the tongue forward end ZS and in the direction opposite to the direction of rotation of the impeller. The forward edge of the bar G adjacent the impeller preferably has an acute angle edge, the opposite side of said bar G being round.

The surface of the bar G adjacent the impeller is at an angle $t$ to a tangential line relative to the outer periphery of the impeller. It is necessary that the intersection angle $t$ be $t > 0°$ because in the case of $t = 0°$ the flow becomes very unstable. It is considered that a suitable value of the central angle $O_b$ is within the range about $20° < O_b <$ about 30° experimentally. Then, the outflow line of the vortex discharged from the impeller produces an effect similar to the Coanda effect along the circular portion of the bar G, whereby the direction of the flow line is bent, the back current line of the vortex being drawn nearer to the bar G with the result that the variable collision inflow against the inflow blade lattice is restricted. With regard to this control bar G it can extend only along a part of the length of the impeller and still be effective.

An impeller having neither a casing nor a tongue member is called a free impeller. The transverse flow in the case of a free impeller is considered to be more or less similar to that of the impeller having a tongue member alone and no casing. In the case of a free impeller, the vortex rotates in the direction of the rotation thereof at a speed about 1/20 of that of the rotation of the impeller. The rotary movement of this vortex can be stopped either by a casing alone or a tongue member alone. However, in either case the rotation noise is unpreventable.

Figure 17A:
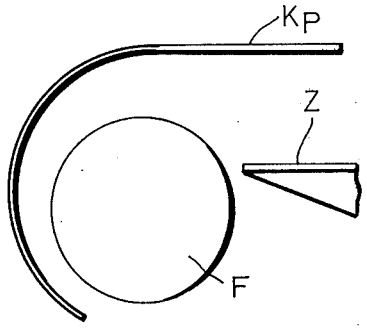
Figure 17B:
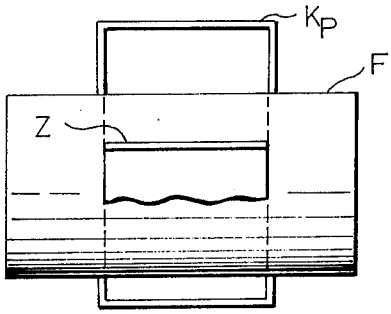

When less than the entire length of the free impeller F is provided with a partial casing $K_p$, as seen in FIGS. 17*a* and 17*b*, a partial flow is established through the partial casing, a tongue member Z and the like. The flow through the residual parts of the free impeller, i.e. the parts projecting beyond the partial casing $K_p$ is simultaneously established. In other words, the flow is stabilized. In this case, the main outflow direction of the two flow parts are different from each other, deviating slightly. The noise can be reduced by suitably guiding the outflow of the free impeller portion.

A diffuser device is sometimes provided in the outflow opening of the casing for the purpose of producing an increase in the static pressure. However, this arrangement never results in improvement of the static pressure coefficient $\Psi\beta$ fundamentally in the transverse flow fan. To be more precise, the so-called diffuser performance can never be expected from this arrangement.

The operation of the transverse flow fan in the part of the curve $\zeta - \Psi$ rising toward the right-hand side is accompanied by a surging phenomenon, and a similar phenomenon also appears adjacent the maximum flow $\zeta$ max, which is often considered to be a pulse variation of the outflow. When this variation is strong, a great variation of pressure or a sudden and violent reduction of pressure is sometimes witnessed. The variation of the flow adjacent the maximum flow $\zeta$ max is even considered to be one of the characteristics of the transverse flow fan. Since this phenomenon is caused by the influence of the closed end plate face *f* (see FIG. 2) of the impeller, it is necessary to reduce the two-dimensional area rectangularly intersecting the rotary shaft axis *a* of the impeller on said closed end plate face f.

The position of the vortex center is substantially on the same axis throughout the entire length of the impeller, although adjacent the closed end plate face *f* of the impeller the vortex region is expands as it nears the end plate face *f*. Moreover, this expansion is accompanied by a pressure variation due to the influence from the end plate face, said variation affecting the entire flow resulting in a pulsation of the outflow. Consequently, the outflow loses its character as a jet stream. One of the best methods for checking this pulse variation is to reduce the slot width SW of the outflow opening shown in FIG. 14. This method has been used heretofore. Referring to FIG. 14, the value of Ao is such as to satisfy the formula $Ao \leqq \frac{1}{2}F_D$, wherein Ao represents the dimension of the slot width SW, $F_D$ representing the diameter of the impeller.

When designing an air curtain, the momentum necessary in relation to the lateral pressure difference is obtainable by the formula, $H_c = kA_oV^2_o/P_s$, wherein *k* is constant, $V_o$ being initial outflow velocity, $P_s$ being lateral pressure difference, $H_c$ being the maximum range of wind. In order to obtain momentum corresponding to an increased lateral pressure difference, the initial outflow velocity has to be increased where the dimension $A_o$ of the slot width SW can not be enlarged. If it is difficult to increase the speed of rotation of the impeller because of increased noise, the outer peripheral diameter $F_D$ of the impeller will have to be increased. It is desirable that the ratio between the dimension $A_o$ of the slot width SW of the outflow opening and the diameter $F_D$ of the impeller, namely, the value of $A_o/F_D$, be as large as possible. It must be noted that the slot width SW here has no connection with the diffuser device. If it is only the object to check the pulse variation of the outflow at the maximum flow $\zeta$ max, this object can be adequately accomplished simply by using the control bar G shown in FIG. 12 adjacent the closed end plate face. However, if it is the object to greatly enlarge the outflow slot width SW, for example, to 0.9 for the value of $A_o/F_D$, this object can be accomplished by providing within the outflow region on the outside of the impeller a protuberant member W, $W_2$ or $W_3$, as shown in FIG. 13, locally projecting into the flow from the end surface of the casing corresponding to the end plate face of the impeller and spaced from the impeller in the direction of the rotation of the impeller.

Figure 18A:
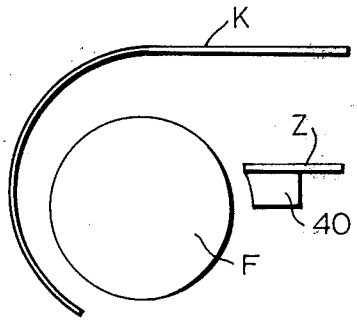
Figure 18B:
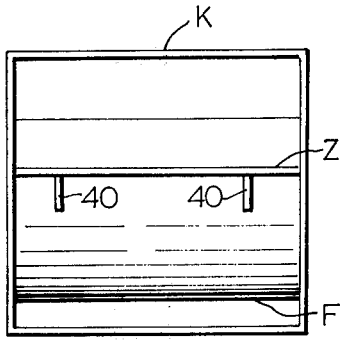

The pulse variation of the flow can also be checked efficiently by guiding the inflow in the inflow space so as to intersect the rotary shaft line of the impeller at right angles particularly adjacent the closed end plate of the impeller. For this purpose, one or more induction plates 40 perpendicular to the impeller shaft axis and positioned on the inflow space side tongue face can be provided adjacent the end plates of the impeller as shown in FIGS. 18*a* and 18*b*.

Figure 19A:
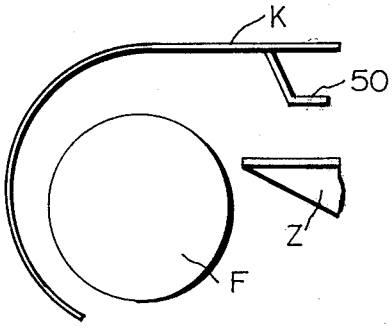
Figure 19B:
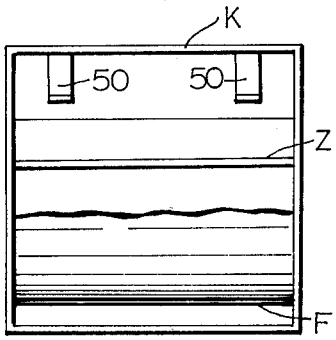

Furthermore, with respect to the outflow space region outside the impeller, it is disadvantageous to restrict it by the central part of the impeller axially thereof in the portion corresponding to the vicinity of the tongue forward end. However, such an arrangement makes it possible to reduce the vortex noise greatly. The vortex noise has a strong tendency to increase or decrease in correspondence with the variation of the interblade flow speed with regard to the outflow blade lattice of the impeller. This variation of the interblade flow does not necessarily correspond to the variation of the flow at the inflow blade lattice of the impeller. In order to check the flow variation at the outflow blade lattice of the impeller, there can be provided a damper construction as shown in FIG. 14 or a damper-like construction for restricting the flow, such as one or more flat resistance plate members 50 extending from the surface of the casing, as shown in FIGS. 19*a* and 19*b*, or from the tongue member, or provided independently adjacent the outflow opening and within the inner or outer outflow region of the impeller so as to reduce the area of the outflow in a required direction, partially, and for a required amount (at least more than 20% experimentally). This makes it possible to provide a transverse flow fan having a greater slot width than heretofore, higher performance and lower noise.

What is claimed is:

1. A transverse flow fan having a casing with an inlet and an outlet, an annular impeller rotatably mounted in said casing between said inlet and said outlet and having outwardly curved blades therein with an inner blade angle $\beta_1$ at the inner periphery of the impeller and an outer blade $\beta_2$ at the outer periphery of the impeller, at least one hand-shaped annular member on said impeller around the outer periphery thereon for partial control of the flow, the casing having end walls generally parallel with the end faces of the annular impeller, a curved outer wall between said end walls and curving around said impeller and to said outlet, and a tongue forming an inner wall having an inflow space side extending from said inlet to a point adjacent said impeller and an outflow space side at an angle of less than 180° to said inflow space side and extending from said impeller to said outlet, the inflow space side of said tongue and said end walls defining an inflow space, said outflow space side of said tongue, said end walls and said outer wall defining an outflow space, the angle $\delta_i$ on the inlet space side of said tongue between the surface of the said torque and a line intersecting the tip of the tongue and parallel to a tangent to the impeller adjacent said tip of said tongue being in the range $(\beta_2 - 15°) \leqq \delta_i \leqq (\beta_2 + 15°)$ and the distance $\epsilon_2$ between the impeller and the tip of the tongue in the radial direction of the impeller being 0.03 $F_D$ to 0.15 $F_D$, wherein $F_D$ is the outside diameter of the impeller.

2. A transverse flow fan according to claim 1 wherein said annular member has a dimension $b$ in the direction of the axis of rotation of the impeller of at least a few mm.

3. A transverse flow fan according to claim 1 further comprising a control bar adjacent said impeller in said outflow space, the one edge of said control bar facing in the direction opposite the direction of rotation of said impeller being pointed and the bar being wedge shaped in cross-section and having a rounded opposite edge, said one edge being spaced along the periphery of said impeller from the tip of said tongue by an impeller central angle $\theta_b$ which is $20° \leqq \theta_b \leqq 30°$, said control bar extending along only a part of the length of the impeller for partial control of the flow.

4. A transverse flow fan according to claim 1 wherein within the outflow region outside of the impeller is at least one protuberant member locally projecting into the flow from the end surface of the casing in substantially the same plane as the end surface of the impeller and along the axis of rotation of the impeller thereby checking the pulse variation of outflow occurring adjacent to the closed end plate face of the impeller.

5. A transverse flow fan according to claim 1 wherein said band-shaped annular member for partial control of the flow has a dimension b in the direction of the axis of rotation of the impeller of at least a few mm.

6. A transverse flow fan having a casing with an inlet and an outlet, an annular impeller rotatably mounted in said casing between said inlet and said outlet, said casing enclosing the impeller over only a part of the length of the impeller, said impeller having outwardly curved blades therein with an inner blade angle $\beta_1$ at the inner periphery of the impeller and an outer blade angle $\beta_2$ at the outer periphery of the impeller, at least one band-shaped annular member on said impeller around the outer periphery thereon for partial control of the flow, the casing having end walls generally parallel with the end faces of the annular impeller, a curved outer wall between said end walls and curving around said impeller and to said outlet, and a tongue forming an inner wall having an inflow space side extending from said inlet to a point adjacent said impeller and an outflow space side at an angle of less than 180° to said inflow space side and extending from said impeller to said outlet, the inflow space side of said tongue and said end walls defining an inflow space, said outflow space side of said tongue, said end walls and said outer wall defining an outflow space, the angle $\delta_i$ on the inlet space side of said tongue between the surface of said tongue and a line intersecting the tip of the tongue and parallel to a tangent to the impeller adjacent said tip of said tongue being in the range $(\beta_2 - 15°) \leqq (\beta_2 + 15°)$ and the distance $\epsilon_2$ between the impeller and the tip of the tongue in the radial direction of the impeller being 0.03 $F_D$ to 0.15 $F_D$, wherein $F_D$ is the outside diameter of the impeller.

7. A transverse flow fan having a casing with an inlet and an outlet, an annular impeller rotatably mounted in said casing between said inlet and said outlet and having outwardly curved blades therein with an inner blade angle $\beta_1$ at the inner periphery of the impeller and an outer blade angle $\beta_2$ at the outer periphery of the impeller, at least one band-shaped annular member on said impeller around the outer periphery thereon for partial control of the flow, the casing having end walls generally parallel with the end faces of the annular impeller, a curved outer wall between said end walls and curving around said impeller and to said outlet, and a tongue forming an inner wall having an inflow space side extending from said inlet to a point adjacent said impeller and an outflow space side at an angle of less than 180° to said inflow space side and extending from said impeller to said outlet, the inflow space side of said tongue and said end walls defining an inflow space, said outflow space side of said tongue, said end walls and said outer wall defining an outflow space, the angle $\delta_i$ on the inlet space side of said tongue between the surface of said tongue and a line intersecting the tip of the tongue and parallel to a tangent to the impeller adjacent said tip of said tongue being in the range $(\beta_2 - 15°) \leqq \delta_i \leqq (\beta_2 + 15°)$ and the distance $\epsilon_2$ between the impeller and the tip of the tongue in the radial direction of the impeller being 0.03 $F_D$ to 0.15 $F_D$, wherein $F_D$ is the outside diameter of the impeller, said tongue extending along only a part of the length of the impeller.

* * * * *